United States Patent [19]

Rivera

[11] 4,333,003

[45] Jun. 1, 1982

[54] RADIANT AIRFLOW HEAT PROCESSING ASSEMBLY

[76] Inventor: Jose I. Rivera, 39-20 55th St., Woodside, N.Y. 11377

[21] Appl. No.: 156,691

[22] Filed: Jun. 5, 1980

[51] Int. Cl.[3] ..... H05B 3/00

[52] U.S. Cl. ..... 219/377; 219/354; 219/355; 219/343

[58] Field of Search ..... 219/553, 342, 347, 349, 219/350, 351, 352, 355, 356, 357, 405, 411, 377, 354, 541, 343, 376, 532; 338/319, 57

[56] References Cited

U.S. PATENT DOCUMENTS

| | | | |
|---|---|---|---|
| 330,449 | 11/1885 | Weston | 338/57 |
| 1,076,858 | 10/1913 | Andrews | 338/319 |
| 1,109,551 | 9/1914 | Shoenberg | 219/356 |
| 1,602,225 | 10/1926 | Gough | 219/357 |
| 1,781,802 | 11/1930 | Bandoly | 338/57 |
| 2,439,005 | 4/1948 | Jensen | 219/354 |
| 2,723,463 | 11/1955 | Latzoni | 219/354 |
| 3,141,089 | 7/1964 | Hultgreen | 219/553 |
| 3,257,542 | 6/1966 | Hultgreen | 219/352 |
| 3,499,232 | 3/1970 | Zimmermann | 219/342 |
| 3,523,179 | 8/1970 | Edwards et al. | 219/553 |
| 3,859,498 | 1/1975 | Steinmetz | 219/352 |

FOREIGN PATENT DOCUMENTS

| | | | |
|---|---|---|---|
| 506255 | 8/1920 | France | 219/351 |
| 117499 | 7/1918 | United Kingdom | 219/356 |

*Primary Examiner*—B. A. Reynolds
*Assistant Examiner*—Bernard Roskoski
*Attorney, Agent, or Firm*—Bauer & Amer

[57] ABSTRACT

A radiant heater comprising a plurality of individual heating elements depending from a pair of spaced apart parallel dielectric members and electrically connected to bus bars that are secured along one longitudinal edge of the dielectric members. The individual heating elements are arranged in a side-by-side relationship along the dielectric members but spaced apart so that air blown downwardly towards the heating elements is heated thereby and passes between and around the heating elements towards a surface to be heated.

9 Claims, 9 Drawing Figures

FIG. 6
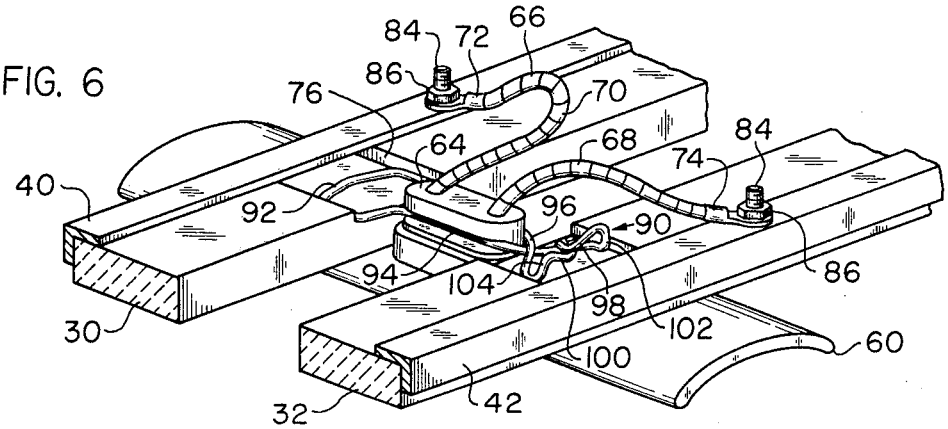
FIG. 7
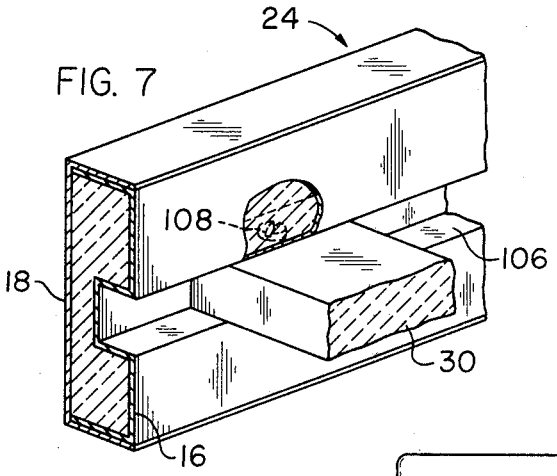
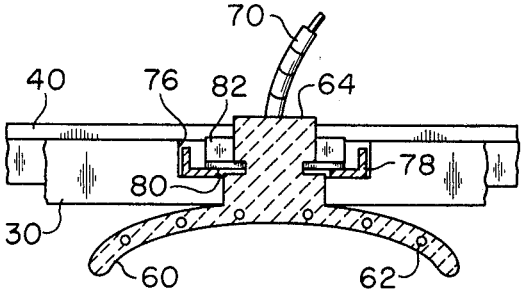
FIG. 3
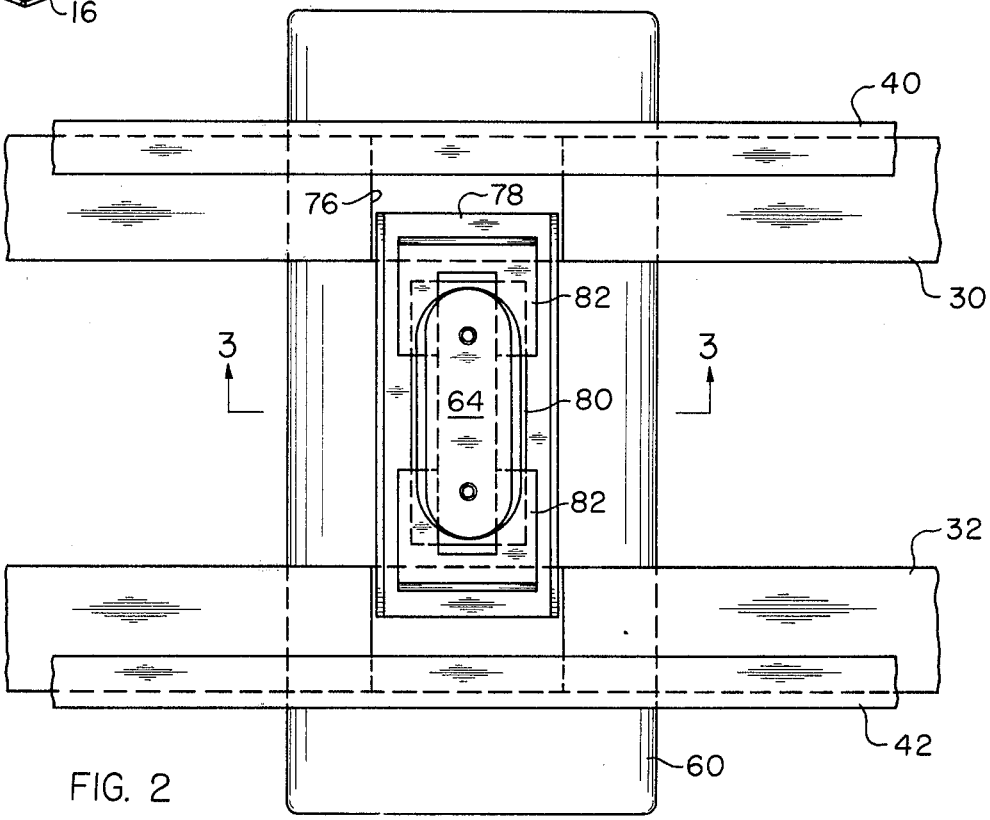
FIG. 2

RADIANT AIRFLOW HEAT PROCESSING ASSEMBLY

BACKGROUND OF THE INVENTION

Radiant heaters have long been provided to dry manufactured articles that are carried below heating elements of the apparatus by a conveyor belt or as a web of material that is to be dried as in the case of printed textiles or paper. Such apparatus is also used to heat soften material which can then be vacuum formed to a desired shape or otherwise processed in the softened state. Heat transfer to the material being dried or heated is accomplished by radiation and also by convection as when a flow of air is directed over the radiant heating elements, where it is heated, and onto the material being processed. Quite often relatively high temperatures are employed to speed the flow of material beneath the heating elements and, as a consequence, the heating elements, and more particularly the electrical leads of the elements and the conductors connecting the elements to a power source, are subject to periodic failure. Such failure requires the apparatus to be shut down so that the damaged heating element can be replaced. The prior art (see, for example, U.S. Pat. No. 3,499,232) was cognizant of this problem and provided means to facilitate the replacement of radiant heating elements.

SUMMARY OF THE INVENTION

The present invention relates to an improved radiant heating apparatus that minimizes the frequency of failure requiring replacement of individual radiant heating elements, or other conductors within the heater enclosure, while at the same time enabling the convenient replacement of individual elements when such does become necessary.

In carrying out the invention, a housing or enclosure preferably having insulated walls is provided with at least one pair of spaced apart parallel support members formed of a dielectric material extending the length of the enclosure. A plurality of radiant heating elements are spaced from each other along the length of the support members. Means for mounting each heating element on the support members permit an element to be readily removed and replaced when required. The electrical connection of each heating element to a power source is made by connecting one of the two leads from the heating element to a rigid non-insulated bus bar that is secured along the length of one support member and the other lead to a second similar bus bar secured to the other support member. In addition to their electrical function, the bus bars give structural rigidity to the support members which otherwise might sag or distort under the high temperatures generated in the heater. The bus bars extend out of the enclosure so that their connection to the flexible conductors of a power source is made away from the heat of the apparatus.

Features and advantages of the invention may be gained from the foregoing and from the description of a preferred embodiment thereof which follows.

BRIEF DESCRIPTION OF THE DRAWING

FIG. 2 is an enlarged detailed view showing how an individual heating element is supported in the heating apparatus;

FIG. 3 is a sectional view taken along line 3—3 of FIG. 2;

FIG. 6 is an isometric view showing a different means for mounting a heating element on the support members;

FIG. 7 is a detailed view showing an alternate construction of the heater enclosure end wall;

DETAILED DESCRIPTION OF A PREFERRED EMBODIMENT OF THE INVENTION

Figure 1:
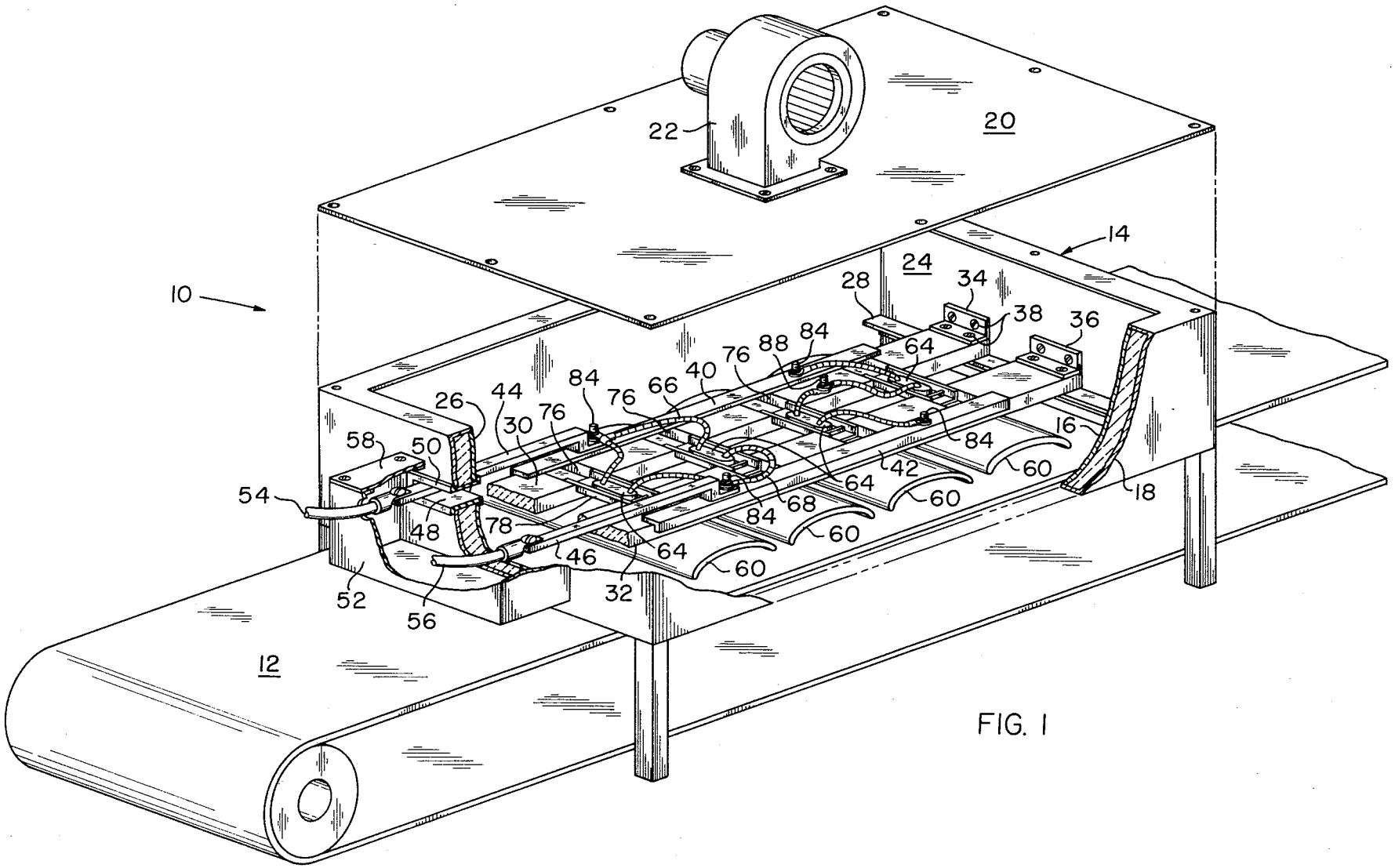
FIG. 1 is an isometric view, with parts broken away, showing the heating apparatus of the present invention.

Referring to FIG. 1, the heating apparatus 10 of the present invention is shown supported above a conveyor belt 12 which may carry articles or material that are to be subjected to heat from apparatus 10. Instead of a conveyor belt carrying articles or material, the heating apparatus may be positioned above a web of material that is fed under the apparatus.

Apparatus 10 includes an enclosure 14 that is essentially a double walled box open on top and bottom. The spacing between the walls 16 and 18 is preferably filled with a heat insulating material which, if the structure is large and fabricated in place, can be a fiberglass blown into the space or an expandable plastic foam injected between the walls. The bottom of enclosure 14 is open since the articles or material to be dried or heated pass immediately below the enclosure and are subjected to the radiant heat and convective air flow emanating from the heating elements located within the enclosure. The top opening of enclosure 14 is closed by a removable cover plate 20 which is shown in one piece but may, in a large or long heating apparatus, include several individually removable sections. A blower 22 for forcing air through the heating apparatus is shown mounted on cover plate 20. It may be preferred, if blower 22 is cumbersome or heavy, that the section of the cover plate to which blower 22 is attached be a non-removable section which remains secured to enclosure 14. It is only required that a sufficient portion of the cover plate be removable to give access to the interior of the enclosure 14 so that the heating elements can be replaced when necessary.

Each end wall 24 and 26 of enclosure 14 is provided with a shelf 28 which may consist of an angle member bolted or otherwise secured to the wall. The shelves serve to support a pair of dielectric support members 30 and 32 which are spaced apart in parallel alignment and extend the length of the enclosure. Members 30 and 32, which may be formed of monobestos, are secured in place by angle brackets 34 and 36, respectively, which are fastened to the members and the end walls 24 and 26 by screws 38.

Arranged along the outside edges of members 30 and 32 are bus bars 40 and 42 which are in the form of elongated angle strips that are fitted over the edges of the dielectric members. The bus bars may be in the form of elongated channel members or simply elongated bars that are secured to the eielectric members. The ends of the bus bars terminate well short of the end walls of enclosure 14 to insure that there is no electrical contact between the bus bars and enclosure 14. In addition to their function as electrical conductors, bus bars 40 and 42 provide structural support to members 30 and 32 which otherwise might sag or distort when subjected to the heat developed in the apparatus.

Rigid bus bar extensions 44 and 46 are electrically connected to bus bars 40 and 42, respectively, and they extend outwardly of enclosure 14 through an opening 48 in end wall 26. An insulated bushing 50 is provided in opening 48 to prevent bus bar extensions 44 and 46 making electrical contact with any metal parts of enclosure 14. The bus bar extensions terminate within a junction box 52 secured to the outside of end wall 26, and there they are connected by flexible insulated conductors 54 and 56 to a source of electric power. Box 52 is provided with a removable cover 58 which permits access to the interior of box 52 and thereby facilitates the connection of conductors 54 and 56 to the bus bar extensions.

Attention is now directed to the individual heating elements 60 and the means by which they are physically mounted within enclosure 14 and electrically connected to the source of electric power. The heating elements 60 may, for example, be GTE Sylvania 220/230 volt Elstein FSR 150 watt radiant heaters in which the electrical resistance wires 62 are embedded in a ceramic body. The heating element is a rectangular member having a curved cross section, as shown, with an elongated boss 64 being formed at the center of the upper convex surface of the element 60. The periphery of boss 64 is undercut, as seet in FIGS. 2 and 3, for a purpose soon to be described. The external leads 66, 68 of resistance wire 62 are insulated with vertebra-like ceramic beads 70 and are provided with electrical connectors 72 and 74 which facilitate connection of the heating element to bus bars 40 and 42.

The dielectric support members 30 and 32 are provided with a series of transverse notches 76 which determine the location and spacing of heating elements 60 within enclosure 14. Into each notch is placed a channel-shaped member 78 having a central aperture 80 through which boss 64 of heating element 60 can extend when the heating element is placed against the underside of support members 30 and 32. To hold heating element 60 in position with its boss 64 extending through aperture 80, a pair of spring clips 82 are slipped into position beneath the overhanging top portion of the boss. Thus, heating elements 60 are securely held along the length of dielectric support members 30 and 32. Instead of notching members 30 and 32, a notched strip could be secured to the inner edges of members 30 and 32. The notches of such a strip could abut the inner sides of the members or they could be located higher than the top surfaces of the members.

Figure 8:
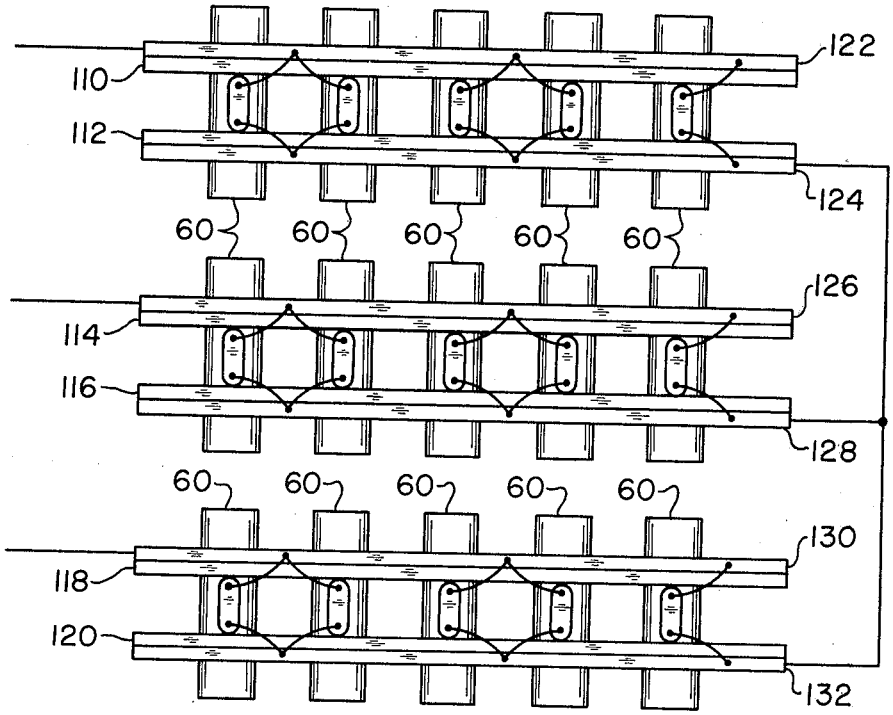
FIG. 8 is a schematic view showing the wiring of the heating elements for a three phase power source.
Figure 4:
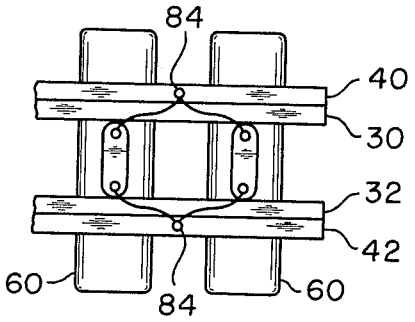
FIG. 4 is a schematic view showing heating elements connected in parallel across the bus bars of the apparatus.

The heating elements 60 are electrically connected to bus bars 40 and 42 by placing a connector 72 over a screw 84 and tightening a nut 86 over the connector. A screw 84 and nut 86 may be provided on each bus bar for each heating element or for two (or more) heating elements as shown in FIGS. 1 and 4. The screws and nuts may also serve the purpose of securing the bus bars to the dielectric support members and to the bus bar extensions, although separate securing means may be provided for these latter purposes. A stud 88 may be provided in dielectric support member 30 so that two adjacent heating elements may be connected in series when a higher voltage power source, e.g., a 440 volt source, is connected to bus bars 40 and 42, see FIG. 5. A particular heating apparatus would be configured either for connecting each heating element 60 directly across the bus bars or for connecting the heating elements in series across the bus bars, depending on the voltage rating of the heating elements and the voltage of the power source. FIG. 1, for illustrative purposes, shows both wiring arrangements. FIG. 8 schematically shows one arrangement for connecting heating elements to a three phase power source.

FIG. 6 discloses another embodiment for mounting heating elements 60 on support members 30 and 32. Here, instead of channel-shaped members 78 and spring clips 82, a single wire clip 90 is used. The base 92 of the clip fits into notch 76 while the side arms 94 and 96 are positioned under the overhanging portion of boss 64. Arm 96 crosses in front of boss 64 and terminates in free end 98 of the clip. Similarly, arm 94 crosses in front of the boss and terminates in free end 100. The arrangement is such that by pressing the upstanding legs 102 and 104 of free ends 98 and 100, respectively, towards each other, the side arms 94 and 96 move apart to allow the overhanging top portion of boss 64 to pass between them. Thus, heating element 60 can be placed in position to be held by wire clip 90 or removed from that position for replacement by another heating element.

FIG. 7 illustrates another construction for the end wall 24 of enclosure 14. In this embodiment, the inner wall 16 is a shaped member having an elongated channel 106 into which one end of dielectric support member 30 is fitted and secured in place by a screw 108. The space between inner wall 16 and outer wall 18 is filled with and insulating material as previously indicated.

Figure 5:
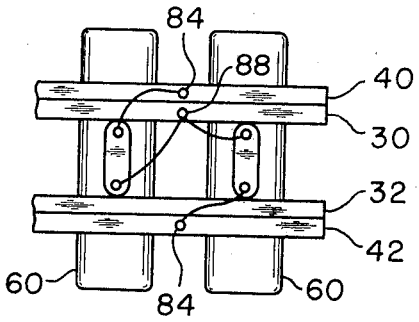
FIG. 5 is a schematic view showing heating elements connected in series across the bus bars of the apparatus.

In the three phase system schematically illustrated in FIG. 8, the heating elements 60 are shown connected as a balanced Y load. The dielectric support members are arranged in three support pairs, 110 and 112, 114 and 116, and 118 and 120, each pair supporting a plurality of heating elements 60. As in the single phase system of FIG. 1, the dielectric support members are each provided with a bus bar 122, 124, 126, 128, 130, and 132 to which the heating elements are connected as shown. Bus bars 122, 126, and 130 will be provided with rigid bus bar extensions (similar to extensions 44 and 46) that extend outside the heater enclosure so that electrical connection to the three phase power supply can be made external to the heating apparatus. The connection between bus bars 124, 128, and 130 preferably will be in the form of a rigid uninsulated cross bar similar to the bus bar extensions and may be made within the heating apparatus enclosure. Of course, the heating elements could be connected as a delta load and, for high voltage installations, two adjoining heating elements in a row of elements could be connected in series as shown in FIG. 5.

The heating apparatus 10 according to the present invention is particularly efficient in drying or heating articles carried by belt 12 when it is noted (see FIG. 9) that the radiant heat directed at the belt is supplemented by the flow of air which is directed over the heating elements 60, where it is heated, and then freely between and around elements 60 to belt 12. The spacing between heating elements 60 and the downwardly curved shape of the elements contribute to the effectiveness of the supplemental convective heat transfer.

It should be noted that the air which contributes to the heating of articles on belt 12 is being heated by passing over heating elements 60 and the exposed current carrying parts, e.g., bus bars 40 and 42 and heating element leads 66, 68, of the apparatus. Thus, the air provided by blower 22 is extracting heat from those parts and thereby minimizing the heat build-up and consequent temperature rise in those parts. This is particularly important with respect to heating elements 60 since the external leads 66, 68 are an especially vulnerable part of the heating element and subject to failure when overheated. The arrangement of heating elements disclosed tends to minimize heating element failures and consequent shut down of the apparatus when heating elements have to be replaced. However, should a heating element 60 fail, its replacement can readily be accomplished. Cover plate 20 or, if the cover plate comprises a plurality of individually removable sections, the section thereof located over the defective heating element is removed. The leads 66, 68 are disconnected from the bus bars 40 and 42, and clips 82 slipped from under the overhanging portion of boss 64, thereby allowing element 60 to be lowered away from channel member 78. A new heating element is then positioned with its boss 64 projecting through aperture 80 of channel member 78 and clips 82 (or wire clip 90) are snapped into position below the overhanging portion of boss 64. After leads 66, 68 are connected to bus bars 40 and 42 and cover plate 12 replaced, the apparatus is again ready for service. It is to be noted that the heating element fastening means, i.e., clips 82 or 90, and the electrical connecting means 84, 86 are locted facing the removable cover plate 12 thus facilitating replacement of a heating element when such is required.

Figure 9:
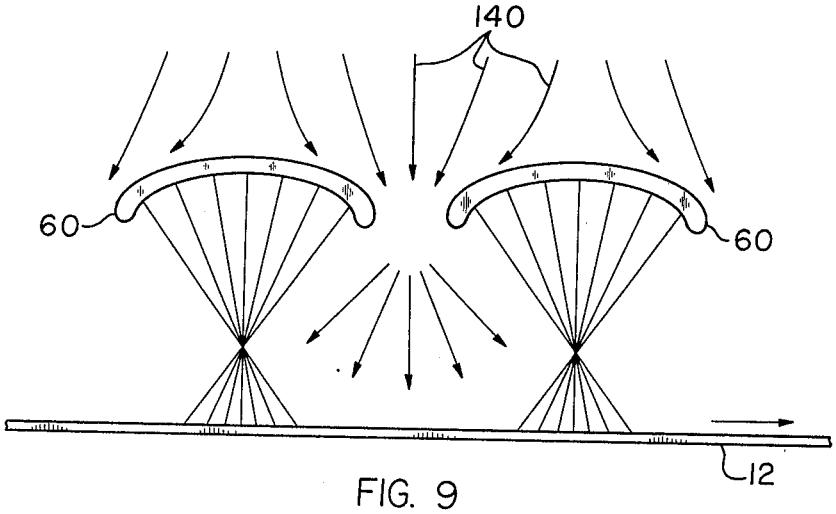
FIG. 9 is an illustration schematically showing how the heating elements heat by radiation and convection.

By relatively spacing the heating elements on the dielectric support members 30 and 32, which themselves are relatively spaced apart, relatively large air spaces are provided around and between the heating elements and the supports. These spaces permit the passage of a large volume of air moving from the blower 22 above to pass unimpeded through the spaces. When the heaters 60 are curved, the flow of air is diverted fully about the heaters as shown in FIG. 9 in the direction of the arrows 140 and aided by the shapes of the heaters. This enables the heat to be focused directly on an object on the conveyer belt 12 to result in a more efficient transfer of heat from the heating elements to the object on the conveyer belt.

Having thus described the invention, it is to be understood that many variations or embodiments thereof could be provided without departing from the spirit and scope thereof. For example, while an apparatus having one row of heating elements 60 is disclosed for a single phase system, such an apparatus having two or more rows of heating elements could be provided for heating a wider area. In such case, connections between bus bar extensions could be made by rigid cross bars outside of enclosure 14 in junction box 52. Thus, the foregoing specification and the accompanying drawing are to be interpreted as illustrative rather than in a limiting sense.

What is claimed is:

1. A radiant heater comprising a heater enclosure having a pair of opposite walls, a pair of spaced apart substantially parallel dielectric support members, each support member extending between said walls and being secured thereto, first bus bar means supported along a longitudinal surface of one of said support members, second bus bar means supported along a longitudinal surface of the other of said support members, one end of each of said bus bar means being spaced from one wall of said enclosure and the other end extending through the opposite wall thereof so that connection of said bus bar means to a power source can be made outside of said enclosure, a plurality of electrical radiant heating elements each having a pair of electrical leads and front and rear heating surfaces, a plurality of support means, one for each heating element, releasably mounting said radiant heating elements in a spaced relationship along said support members such that the front surfaces thereof are oriented to radiate heat towards an area to be heated, connector means for electrically connecting the leads of said heating elements to said first and said second bus bar means, and blower means for blowing air directly at the leads and rear surfaces of said heating elements and towards the area to be heated whereby the air absorbs heat from the leads and rear surfaces of said heating elements which is transferred to the area to be heated by convection to supplement the radiant heating effect of said heating elements.

2. A radiant heater according to claim 1 wherein said support means extend between said dielectric support members and wherein said support members are provided with notches into which said support means are placed to determine the location of the heating elements along said support members.

3. A radiant heater according to claim 2 wherein said heating element support means comprises wire clip means.

4. A radiant heater according to claim 2 wherein said heating element support means comprises a transverse member having a central aperture through which a portion of a heating element projects, and clip means for securing a heating element to said transverse member.

5. A radiant heater according to claim 1 including terminal means mounted on at least one of said dielectric support members whereby two heating elements can be wired in series with said terminal means forming the common junction between said heating elements.

6. A radiant heater comprising a heater enclosure having end walls, side walls, and removable cover means, a first dielectric support member extending longitudinally within said enclosure from one wall to the wall opposite thereto, a second dielectric support member spaced from and substantially parallel to said first support member, said support members being secured to said heater enclosure walls, first bus bar means supported along an edge of said first support member and electrically insulated from said enclosure, said bus bar means extending out of said enclosure through an opening in one wall thereof, second bus bar means supported along an edge of said second support member and electrically insulated from said enclosure, said second bus bar means extending out of said enclosure through an opening in one wall thereof, a plurality of individual electrical radiant heating elements each having a pair of electrical leads and front and rear heating surfaces, said heating elements being arranged in spaced relationship to each other and the walls of said enclosure with the front surfaces thereof facing the area to be heated, a plurality of spaced apart supporting means each extending between said dielectric support members and releasably holding a heating element, connector means for electrically connecting the leads of said heating elements to said bus bar means, and blower means for blowing air directly at the rear surfaces of said heating elements and through the spaces therearound to the area to be heated.

7. A radiant heater according to claim 6 wherein said support members provide means for locating said support means to effect the spacing of said heating elements.

8. A radiant heater according to claim 7 wherein said support means comprises releasable clip means.

9. A radiant heater according to claim 6 wherein said releasable support means and said electrical connecting means are accessible when said cover means is removed, whereby a heating element is readily replaceable.

* * * * *